United States Patent [19]

Wernicke

[11] 4,299,913

[45] Nov. 10, 1981

[54] PHOTOGRAPHIC REVERSAL PROCESS WITHOUT SECOND EXPOSURE

[75] Inventor: Ubbo Wernicke, Odenthal, Fed. Rep. of Germany

[73] Assignee: Agfa-Gevaert AG, Leverkusen, Fed. Rep. of Germany

[21] Appl. No.: 87,050

[22] Filed: Oct. 22, 1979

Related U.S. Application Data

[63] Continuation of Ser. No. 946,361, Sep. 27, 1978, abandoned.

[30] Foreign Application Priority Data

Oct. 1, 1977 [DE] Fed. Rep. of Germany ..... 2744356

[51] Int. Cl.[3] ..... G03C 5/50

[52] U.S. Cl. ..... 430/379; 430/486; 430/490; 430/492

[58] Field of Search ..... 430/379, 407, 490, 486, 430/492

[56] References Cited

U.S. PATENT DOCUMENTS

| | | | |
|---|---|---|---|
| 1,663,959 | 3/1928 | Schestakoff | 430/490 |
| 3,141,771 | 7/1964 | Bard et al. | 430/379 |
| 3,471,295 | 10/1969 | Bockly et al. | 430/551 |
| 3,617,282 | 11/1971 | Bard | 430/379 |
| 3,658,535 | 4/1972 | Willems | 430/379 |
| 3,732,104 | 5/1973 | Vandenabeele et al. | 430/607 |
| 4,055,426 | 10/1977 | Ogawa et al. | 430/490 |
| 4,162,161 | 7/1979 | Shimamura et al. | 430/379 |

FOREIGN PATENT DOCUMENTS

| | | | |
|---|---|---|---|
| 25956 | 7/1971 | Japan | 430/407 |
| 38816 | 9/1972 | Japan | 430/407 |
| 1467007 | 3/1977 | United Kingdom | 430/379 |
| 1515167 | 6/1978 | United Kingdom | 430/379 |

*Primary Examiner*—Won H. Louie, Jr.

*Attorney, Agent, or Firm*—Connolly and Hutz

[57] ABSTRACT

The stability of baths containing fogging agents, especially the stability of baths containing tin-II-ions, is increased by addition of an agent of the following formula

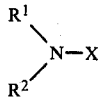

respectively, a tautomeric or a salt thereof, the meaning of the substituents being as indicated in the specification.

8 Claims, No Drawings

PHOTOGRAPHIC REVERSAL PROCESS WITHOUT SECOND EXPOSURE

CROSS REFERENCE

This is a continuation of Applicant's copending U.S. Application Ser. No. 946,361 filed Sept. 27, 1978 for "Photographic Reversal Process Without Second Exposure" by Ubbo Wernicke, now abandoned.

This invention relates to an improved reversal process for the production of photographic images.

In the usual photographic reversal processes for the production of positive black and white or coloured photographs, the photographic material is developed in a first developer after it has been exposed image-wise. It is then exposed uniformly before it is subjected to a second development using a black and white or colour developer. The process is completed by bleaching and/or fixing or bleach fixing of the photographic material.

These reversal processes can be considerably simplified and made more reliable if one is able to replace the second exposure by some other suitable treatment of the photographic material. The second exposure is particularly difficult to handle when processing roll films or miniature films in spirals or flat films in flat film holders designed for repeated use.

It is known that the second exposure can be eliminated by using chemical fogging agents, which should be added at the latest, at the second development stage. Compounds such as boranocarbonates, borohydrides and alkylaminoboranes have been described for this purpose, for example in German Offenlegungsschrift No. 1,622,258.

The disadvantage of these compounds is that when in solution they are sensitive to atmospheric oxygen so that their concentration does not remain constant. This defect is particularly troublesome in the fogging baths hitherto used because the optimum degree of fogging depends on maintaining a certain concentration of fogging agent within very narrow limits. If, for example, a higher than optimum concentration is used initially in order to compensate for the loss due to oxidation by atmospheric oxygen during use, the desired nuclei formation is accompanied by an undesirable excessive reduction of silver halide so that there is insufficient silver halide left for producing the dye in the second colour developer.

The fogging baths discussed in German Offenlengungschrift Nos. 1,814,834 and 2,009,693 contain tin-II ions in complex formation as fogging agents. Although the concentration of oxidizable free metal ions is kept extremely low in these baths, the possibility of oxidation is still sufficient to require further stabilization of the fogging agent against atmospheric oxygen. Furthermore, these fogging baths show a strong tendency to form mold.

The stability of the fogging agents increases with decreasing pH of the solutions containing them. The universal application of fogging agents in strongly acid solutions is, however, inadvisable because firstly, some of the dyes conventionally used in photographic materials are attacked under strongly acid conditions and secondly, if the photographic material is directly transferred from the bath containing fogging agent to the alkaline colour developer, which is in itself convenient and desirable, the amount of acid carried into the colour developer bath from the fogging agent bath cannot be accurately controlled and may impair the activity of the colour developer.

It is therefore an object of the present invention to provide a photographic reversal process in which the stability of the baths containing fogging agent is increased and the disadvantages of the known baths are obviated. It is particularly an object of this invention to increase the stability of baths which contain complexes of suitable metal ions as fogging agents, in particular complexes of tin-II ions.

It has now been found that such stabilization can be achieved if the baths containing the fogging agent, in particular the preliminary baths used before the second development stage contain, in addition to the metal complexes, at least one stabilizing agent, corresponding to the following general formula or to a tautomeric form thereof

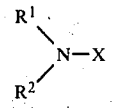

or a salt thereof, wherein $R^1$ and $R^2$ which may be the same or different, represent hydrogen, a saturated or unsaturated aliphatic group, an aryl group, a heterocyclic group or an acyl group;

X represents $OR^3$ or $NR^4R^5$, wherein $R^3$, $R^4$ and $R^5$, which may be the same or different, are defined as $R^1$; and/or $R^1$ and $R^2$ together represent the ring members required for completing a ring, preferably a 5 or 6 membered ring.

The radicals $R^1$, $R^2$, $R^3$, $R^4$ and $R^5$ can be further substituted with suitable substituents known in the photographic field. Such substituents are preferably alkyl, especially with with 1–4 C-atoms; cycloalkyl, especially with 5 or 6 C-atoms; aryl, especially phenyl and heterocyclyl.

The acyl groups are preferably those derived from aliphatic or aromatic carboxylic or sulphonic acids, including carbonic acid monoesters, carbamic acids and sulphamic acids. Examples of such acyl groups include formyl, acetyl, benzoyl, phenylcarbamoyl and ethoxycarbonyl groups.

Suitable stabilizing agents are e.g. acetyl-2-phenyl hydrazine, hydroxyl ammonium sulphate. Particularly suitable stabilizing agents are compounds according to the general formula wherein X represents OH and $R^1$ represents hydrogen, a saturated or unsaturated aliphatic group, an aryl group, a heterocyclic group or an acyl group, especially the following compounds:

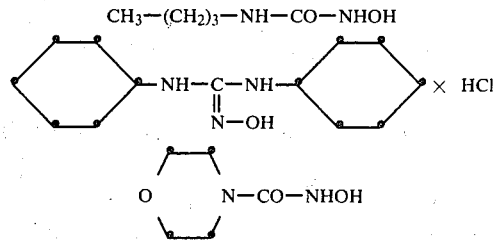

Particularly suitable stabilizing agents are those, wherein $R^1$ represents a substituted acyl group.

The heterocyclic groups are preferably 5- or 6-membered N-containing groups.

Suitable concentrations of stabilizing agents are preferably from 0.5 mMol to 200 mMol, particularly from 2 mMol to 20 mMol per liter of the bath containing them. The quantity of stabilizing agent is calculated to provide sufficient stabilization of the fogging agent but at the same time to ensure that the stabilizing agent will only act to a minor extent on the photographic material itself.

The pH value of the baths used according to the present invention may vary within wide limits and is preferably from pH 3 to pH 8. It is particularly within these pH values that excellent results are obtained, provided that a suitable buffer is used in the bath to ensure a sufficient buffering capacity within the desired pH range.

The fogging agents may be employed at the usual concentrations.

For the replenishment of the fogging bath the fogging agents can be added as liquid concentrates which can be diluted up to hundred fold.

The stabilizing agents used according to the invention can be prepared according to known methods (Houben-Weyl, Vol. 10/4, page 192 seq. and Chemische Berichte, 101 (1968), pages 3344 seq.).

Carboxylic or phosphonic acids are particularly suitable as complex formers for the fogging agents. Examples of these are as follows: aminocarboxylic acids, e.g. ethylene diaminotetracetic acid and those mentioned in German Offenlegungsschrift No. 1,814,834; hydroxycarboxylic acids such as gluconic acid and citric acid; phosphonic acids such as nitrilomethylene phosphonic acids and alkylidene phosphonic acids such as those mentioned in German Offenlegungsschrift No. 2,009,693, azacycloalkane-2,2-diphosphonic acids such as those mentioned in German Offenlegungsschrift No. 2 610 678, or phosphonocarboxylic acids which have at least one carboxyl and at least one phosphonic group in the molecule, in particular acids corresponding to the following general formula:

$$\begin{array}{c} R^7R^8C-COOH \\ | \\ R^9R^{10}C-COOH \end{array}$$

wherein $R^7$, $R^8$, $R^9$, $R^{10}$ which may be the same or different, represent hydrogen, an alkyl group with from 1 to 4 carbon atoms, a hydroxyl group or $(CH_2)_mX$ wherein X represents a phosphono group or a carboxyl group and m represents 0 or an integer of from 1 to 4 with the proviso that at least one of the substituents $R^7$ to $R^{10}$ is a phosphono group or contains one.

A particularly suitable acid is 1,2,4-tricarboxybutane-2-phosphonic acid.

The above mentioned complex formers may be used either singly or in combination in the baths used according to the present invention, and optionally they may be used in excess, based on the quantity of tin-II ions present.

The conventional colour developer substances may be used for development in the photographic reversal process according to the present invention, for example:

N,N-dimethyl-p-phenylene diamine,
4-amino-3-methyl-N-ethyl-N-methoxy ethylaniline,
monomethyl-p-phenylene diamine,
2-amino-5-diethylamino toluene,
N-butyl-N-ω-sulphobutyl-p-phenylene diamine,
2-amino-5-(N-ethyl-N-β-methanesulphonamidoethyl)-amino)-toluene,
N-ethyl-N-β-hydroxyethyl-p-phenylene diamine,
N,N-bis-(β-hydroxyethyl)-p-phenylene diamine, and
2-amino-5-(N-ethyl-N-β-hydroxyethylamino)-toluene Other suitable colour developers have been described, for example, in J. American Chem. Soc. 73, 3100 (1951).

The process according to the present invention is also applicable to the treatment of a light-sensitive photographic material which contains couplers. These couplers may be the conventional colour couplers, which are generally incorporated directly in the silver halide layers. Thus, the red sensitive layer, for example, contains a non-diffusible colour coupler for the production of the cyan partial colour image, generally a coupler of the phenol or α-naphthol series, the green sensitive layer contains at least one non-diffusible colour coupler for the production of the magenta partial colour image, usually a colour coupler of the 5-pyrazolone or the indazolone series, and the blue sensitive layer contains at least one non-diffusible colour coupler for the production of the yellow partial colour image, generally a colour coupler containing an open chain keto-methylene group. Many colour couplers of this type are known and have been described in numerous patent specifications and other publications, for example, in the publication entitled "Farbkuppler" by W. Pelz in "Mitteilungen aus den Forschungslaboratorien der Agfa, Leverkusen/München", volume III (1961) and the publication by K. Venkataraman in "The Chemistry of Synthetic Dyes", Vol 4., pages 341–387, Academic Press, 1971.

The non-diffusible colour couplers used may be 2-equivalent couplers. These contain a removable substituent in the coupling position so that they require only 2 equivalents of silver halide for colour formation, in contrast to the usual 4-equivalent couplers. Suitable 2-equivalent couplers include, for example, the known DIR couplers in which the removable group is released as a diffusible development inhibitor after the reaction with colour developer oxidation products. The so-called white couplers may also be used for improving the properties of the photographic material.

The non-diffusible colour couplers and colour producing compounds may be added to the light-sensitive silver halide emulsions or other casting solutions by conventional methods. If they are soluble in water or alkali, they may be added to the emulsions in the form of an aqueous solution, optionally with the addition of water-miscible organic solvents such as ethanol, acetone or dimethylformamide. If the non-diffusible colour couplers or colour producing compounds used are not soluble in water or alkali, they may be emulsified using a known method, for example, by mixing a solution of the compound in a low boiling organic solvent either directly with the silver halide emulsion or first with an aqueous gelatine solution, and then removing the organic solvent in the usual manner. An emulsion of the given compound in gelatine obtained in this way is then mixed with the silver halide emulsion. The so-called coupler solvents or oil formers may also be added for emulsifying such hydrophobic compounds. These coupler solvents or oil formers are generally higher boiling organic compounds which form oily droplets enclosing the non-diffusible colour couplers and development inhibitor releasing compounds which are required to be emulsified in the silver halide emulsions. Information on this may be found, for example, in U.S. Pat. Nos. 2,322,027; 2,533,514; 3,689,271 and 3,765,897.

The conventional silver halide emulsions are suitable for the process of the present invention. The silver halide contained in them may be silver chloride, silver bromide, silver iodide or mixtures thereof. The binder used for the photographic layers is preferably gelatine, but this may be partly or completely replaced by other natural or synthetic binders. Suitable natural binders include, for example, alginic acid and its derivatives such as its salts, esters or amides, cellulose derivatives such as carboxymethyl cellulose, alkyl celluloses such as hydroxy ethyl cellulose, starch or its derivatives such as its ethers or esters, or carrageenates. Suitable synthetic binders include polyvinyl alcohol, partially saponified polyvinyl acetate, and polyvinyl pyrrolidone.

The emulsions may also be chemically sensitized, for example by the addition of sulphur compounds such as allyl isothiocyanate, allylthiourea, and sodiumthiosulphate at the chemical ripening stage. Reducing agents may also be suitable chemical sensitizers, for example, the tin compounds described in Belgian Pat. Nos. 493,464 and 568,687, or polyamines such as diethylene triamine or aminomethane sulphinic acid derivatives, e.g. according to Belgian Patent Noble metals such as gold, platinum, palladium, iridium, ruthenium or rhodium and compounds of these metals are also suitable chemical sensitizers. This method of chemical sensitization has been described in an article by R. Koslowsky, Z. Wiss. Phot. 46, pages 65–72 (1951). The emulsions may also be sensitized using polyalkylene oxide derivatives, e.g. using a polyethylene oxide having a molecular weight of from 1,000 to 20,000, or using the condensation products of alkylene oxides with aliphatic carboxylic acids, aliphatic amines, aliphatic diamines or amides. The condensation products should have a molecular weight of at least 700, preferably more than 1,000. The sensitizers may, of course, be used in combination to achieve particular effects, as described in Belgian Pat. No. 537,278 and British Pat. No. 727,982. The emulsions may also be spectrally sensitized, e.g. using the conventional monomethine or polymethine dyes such as acidic or basic cyanines, hemicyanines, streptocyanines, merocyanines, oxonoles, hemioxonoles, styryl dyes and others, including also trinuclear or higher nuclear methine dyes, for example rhodacyanines or neocyanines. Sensitizers of this type have been described, for example, in the work by F. M. Hamer entitled "The Cyanine Dyes and Related Compounds" (1964), Interscience Publishers John Wiley and Sons. The emulsions may contain conventional stabilizers, e.g. homopolar mercury compounds or mercury salts containing aromatic or heterocyclic rings, such as mercaptotriazoles, simple mercury salts, sulphonium mercury double salts and other mercury compounds. Azaindenes are also suitable stabilizers, particularly tetra- and penta- azaindenes and especially those which are substituted with hydroxyl or amino groups. Compounds of this type have been described in the article by Birr, Z. Wiss. Phot., 47, pages 2–58(1952). Other suitable stabilizers include heterocyclic mercapto compounds, e.g. phenylmercaptotetrazole, quaternary benzothiazole derivatives, and benzotriazole.

The emulsions may be hardened in the conventional manner, for example, using formaldehyde or halogen-substituted aldehydes containing a carboxyl group, such as mucobromic acid, di-ketones, methanesulphonic acid esters, and dialdehydes.

The photographic layers may also be hardened using epoxide hardeners, heterocyclic ethyleneimine hardeners or acryloyl hardeners. Examples of such hardeners have been described, e.g. in German Offenlegungsschrift No. 2,263,602 or in British Pat. No. 1,266,655. The layers may also be hardened by the process according to German Offenlegungsschrift No. 2,218,009 to produce colour photographic materials which are suitable for high temperature processing.

The photographic layers or colour photographic multi-layered materials may also be hardened using hardeners of the diazine, triazine or 1,2-dihydroquinoline series as described in British Pat. Nos. 1,193,290; 1,251,091; 1,306,544 and 1,266,655; French Pat. No. 7,102,716 and German Offenlegungsschrift 23 32 317. Examples of such hardeners include diazine derivatives containing alkyl sulphonyl or arylsulphonyl groups, derivatives or hydrogenated diazines or triazines such as 1,3,5-hexahydrotriazine, fluoro-substituted diazine derivatives such as fluoropyrimidines, and esters of 2-substituted 1,2-dihydroquinoline- or 1,2-dihydroisoquinoline-N-carboxylic acids. Vinyl sulphonic acid hardeners, carbodiimide hardeners and carbamoyl hardeners. e.g. those described in German Offenlegungsschrift Nos. 2,263,602; 2,225,230 and 1,808,685; French Pat. No. 1,491,807; German Pat. No. 872,153 and DDR Pat. No. 7218 may also be used. Other suitable hardeners have been described, for example, in British Pat. No. 1,268,550.

The conventional layer substrates are used, for example foils of cellulose nitrate, cellulose acetate such as cellulose treacetate, polystyrene, polyesters such as polyethylene terephthalate, polyolefines such as polyethylene or polypropylene, baryta paper supports and laminated polyolefines, e.g. polyethylene laminated paper supports, and glass.

According to the process of the present invention, the photographic reversal material containing at least one silver halide emulsion layer is exposed imagewise and subjected to a black and white development and optionally a stop bath and washing. The photographic material is then treated in a bath containing a solution of the fogging agent which has been stabilized according to the present invention. The bath containing the fogging agent may, if desired, be combined with a bath normally used between the first and second development of the photographic material. The photographic material which has been treated in this way is then developed in a second developer to produce a positive reversal image. Conventional reagents may be used to adjust the pH of the second developer to an alkaline value. The second developer may also contain conventional constituents such as complex formers.

If desired, the photographic material may be treated with an alkaline bath after its treatment with the bath which contains the fogging agent, but before the second development.

The advantage of the process according to the present invention compared with the methods of fogging previously used lies in the stabilization of the fogging agent, particularly in that this is also ensured at higher pH values of from pH 3 to pH 8. This stabilization, particularly that of hydroxylamine, is all the more astonishing since it is known that hydroxylamine, for example, can have an oxidizing action on tin-II compounds, so that there was a considerable prejudice to be overcome against the use of hydroxylamine as an anti-oxidizing agent for fogging baths. Furthermore, the addition of the compound used according to the present invention surprisingly inhibits mold formation.

The process of the present invention is illustrated by the following Examples.

EXAMPLE 1

A commercially available colour photographic multi-layered reversal material comprising a red sensitive, a green sensitive and a blue sensitive silver halide emulsion layer containing colour couplers for each of the partial images in the appropriate light sensitive layers, is exposed imagewise in the conventional manner. The exposed colour photographic material is then subjected to a first development in a developer of the following composition (quantities given per liter of developer:

| Development Bath 1 | |
|---|---|
| p-methylaminophenol | 3.0 g |
| hydroquinone | 6.0 g |
| sodium carbonate | 40.0 g |
| sodium sulphite | 50.0 g |
| potassium bromide | 2.0 g |
| potassium iodide | 0.01 g |
| potassium thiocyanate | 2.5 g |
| pH 10.2 | |

After a stop bath, the photographic material is washed and then treated with the prebath indicated below. A colour reversal second development is then carried out in a bath of the following composition (quantities indicated per liter of developer):

| Development Bath 2 | |
|---|---|
| sodium sulphite | 5.0 g |
| hydroxylamine sulphate | 1.2 g |
| N,N-diethyl-p-phenylenediaminosulphate | 5.0 g |
| trisodium phosphate | 60.0 g |
| potassium bromide | 2.0 g |
| ethylene diaminotetracetic acid | 2.0 g |

The pH is adjusted to a value of 12.1 using NaOH.

The photographic material is then treated in a stop bath and washed and then bleached and fixed and finally washed in known manner.

To prepare the prebath mentioned above, the tin-II complex of ethylenediaminotetracetic acid is prepared according to the method given in German Offenlegungsschrift No. 1,814,834, Example 7, page 23. 3.0 g of tin-II hydrochloride and the quantities of other reactants corresponding thereto are used. Water is added to the resulting solution of the tin-II complex in such quantities that the solution can be divided into three portions (Samples A, B and C) of 900 ml each.

Prebath A

The pH of Sample A is adjusted to a value of 5 and the solution is made up to 1,000 ml with water.

Prebath B 3.0 g of acetyl-2-phenylhydrazine dissolved in 20 ml of methanol are added to Sample B. The pH is adjusted to a value of 5 using sodium acetate and the solution is made up to 1,000 ml with water.

Prebath C 2.7 g of hydroxyl ammonium sulphate are added to Sample C. The pH is adjusted to a value of 5 using sodium acetate and the solution is made up to 1,000 ml with water.

When freshly prepared prebaths A, B and C are used, virtually identical maximum colour densities $D_{Max}$ are obtained. If, however, the prebaths are used after they have been left to stand for one week, a considerable drop in the maximum colour densitites is observed when using prebath A, whereas excellent maximum colour densities continue to be obtained in the process according to the present invention (using prebaths B and C). This is to be attributed to the stabilization of these preliminary baths.

TABLE 1

Maximum colour densities after one week's storage.

| Prebath | Maximum colour densities $D_{Max}$ yellow | magenta | cyan |
|---|---|---|---|
| A | 2.68 | 1.65 | 0.80 |
| B | 3.30 | 4.15 | 3.06 |
| C | 3.70 | 3.80 | 3.05 |

EXAMPLE 2

The colour photographic multi-layered reversal material described in Example 1 is exposed and processed in the same way as described in Example 1, except that instead of the prebaths described in Example 1, those described below are used.

To prepare these prebaths, 12.5 g of sodium gluconate are dissolved in 80 ml of water, 2.5 g of tin-II hydrochloride are then added and the solution is made up to 100 ml. 20 ml of this solution are used for preparing each of the prebaths D, E and F.

Prebath D 20 ml of the above-described solution are diluted with water to 1,000 ml and the pH is adjusted to a value of 5.

Prebath E 20 ml of the solution described above are diluted to 900 ml with water. 5 g of acetyl-2-phenylhydrazine dissolved in 30 ml of methanol are added and the pH of the solution is adjusted to a value of 5 using NaOH and the solution is made up to 1,000 ml with water.

Prebath F

The method is the same as that used for preparing prebath E, except that 4.0 g of hydroxyl ammonium sulphate are used instead of 5 g of acetyl-2-phenylhydrazine.

Prebath G

For further comparison, the tin-II complex of gluconic acid is prepared as described in British Pat. No. 1,467,007, page 2, lines 50–65. The resulting solution is diluted with water until its concentration of tin-II ions is the same as in prebaths D, E and F. The same volume of prebath is used as in baths D, E and F.

Whereas all the prebaths D to G produce virtually identical maximum colour densities when used fresh, a considerable loss in colour density is observed when prebath G and D are used after they have been left to stand for one week, whereas excellent maximum colour densities continue to be obtained in the process according to the present invention (using prebaths E and F). This is shown in Table 2.

TABLE 2

| Maximum colour densities after one week's storage. | | | |
|---|---|---|---|
| | Maximum colour densities $D_{Max}$ | | |
| Prebath | yellow | magenta | cyan |
| D | 2.70 | 1.61 | 0.82 |
| E | 3.65 | 4.10 | 3.03 |
| F | 3.81 | 3.92 | 3.04 |
| G | 2.81 | 1.71 | 0.87 |

EXAMPLE 3

The colour photographic multi-layered reversal material described in Example 1 is exposed and processed as described in Example 1, except that instead of the prebaths described in Example 1, prebaths H, I and K described below are used. To prepare these baths, 6.5 g of the disodium salt of 1-hydroxyethane-1,1-diphosphonic acid are dissolved in 50 ml of water, and 5 g of tin-II hydrochloride are added. Sodium hydroxide is then added until a clear solution is obtained. The pH of this solution is adjusted to a value for 5 and the solution is then made up to 100 ml with water. 10 ml of this solution are used in each case to prepare prebaths H, I and K.

Prebath H 10 ml of the solution are diluted to 800 ml with water and buffered by the addition of glacial acetic acid and sodium acetate. The pH is adjusted to a value of 5 and the solution finally diluted to 1,000 ml with water.

Prebath I 5 g of acetylphenylhydrazine are dissolved in 30 ml of methanol, and 900 ml of water are added. The pH is adjusted to a value of 5 using NaOH. 10 ml of the solution of tin-II complex mentioned above are added to this solution, and finally the volume is made up to 1,000 ml with water.

Prebath K

The procedure is the same as described for Preliminary Bath I, except that 2.7 g of hydroxylammonium sulphate are used instead of the solution of acetyl-2-phenylhydrazine in methanol.

Excellent maximum colour densities are obtained with the freshly prepared prebaths. After the baths have been left to stand for two weeks, however, there is a marked drop in the colour densities obtained with prebath H, whereas excellent maximum colour densities continue to be obtained in the process according to the present invention (prebaths I and K), as can be seen from Table 3 below.

TABLE 3

| Maximum colour densities after a storage time of two weeks. | | | |
|---|---|---|---|
| | Maximum colour densities $D_{Max}$ | | |
| Prebath | yellow | magenta | cyan |
| H | 2.62 | 2.10 | 0.92 |
| I | 3.70 | 3.78 | 3.01 |
| K | 3.60 | 3.70 | 3.05 |

EXAMPLE 4

The colour photographic multi-layered reversal material described in Example 1 is exposed and processed as described in Example 1, but the prebaths L and M described below are used instead of the prebaths described in Example 1. To prepare these prebaths L and M, 5 g of tin-II chloride are dissolved in 25 ml of a 50% solution of 1,2,4-tricarboxybutane-2-phosphonic acid and the resulting solution is made up to 100 ml with water. 10 ml of this solution are used in each case for preparing the prebaths.

Prebath L 10 ml of the solution are made up to 1,000 ml with water and the pH is adjusted to a value of 5 using NaOH.

Prebath M 2.7 g of hydroxylammonium sulphate are dissolved in 950 ml of water, and 10 ml of the solution described above are added. The pH is adjusted to a value of 5 using NaOH and the solution is made up to 1,000 ml with water.

Excellent maximum colour densities are obtained with the freshly prepared prebaths L and M but after they have been left to stand for 8 days, there is a marked drop in the colour densities obtained with prebath L, whereas excellent maximum colour densities continue to be obtained in the process according to the present invention (prebath M), as can be seen from Table 4 below.

TABLE 4

| Maximum colour densities after 8 day's storage. | | | |
|---|---|---|---|
| | Maximum colour densities $D_{max}$ | | |
| Prebath | yellow | magenta | cyan |
| L | 2.25 | 1.82 | 0.92 |
| M | 3.40 | 4.10 | 3.22 |

EXAMPLE 5

The colour photographic reversal multi-layer material described in Example 1 is exposed and processed further, as described in Example 1, except that instead of the prebaths described in Example 1 the prebaths N,O,P and Q are used as described in the following. In order to prepare these prebaths 36 g of trisodium citrate$\times 5.5H_2O$ are dissolved in 150 ml water and, after the addition of 10 g tin-II-chloridedihydrate, stirred until a clear solution is obtained. The pH-value is adjusted to 5.0 with citric acid or NaOH and then water is added to make up an amount of 200 ml.

In order to prepare the prebaths 20 ml of this concentrate are diluted with water to make up an amount of 1000 ml, if necessary adding the substances listed in table 5 in the stated quantities.

While the newly prepared prebaths N, O, P and Q all produce ecellent and practically the same maximum densities after a standing time of 8 days, during which the samples were stirred, the comparative bath N is seen to produce a definite decrease in the maximum densities, whereas when using the baths to be used according the invention excellent maximum colour densities continue to be obtained, as can be seen from the following table 5.

TABLE 5

| Prebath | Compound | added amount [g] | Maximum color density $D_{Max}$ yellow | magenta | cyan |
|---|---|---|---|---|---|
| N | — | — | 2,28 | 1,58 | 0,97 |
| O | I | 1,0 | 3,46 | 3,97 | 3,37 |

TABLE 5-continued

| Pre-bath | Compound | added amount [g] | Maximum color density $D_{Max}$ yellow | magenta | cyan |
|---|---|---|---|---|---|
| P | II | 0,5 | 3,27 | 3,42 | 3,29 |
| Q | III | 1,0 | 3,44 | 3,93 | 3,36 |

The compounds of tab. 5 correspond to the following structures:

compound I $CH_3—(CH_2)_3—NH—CO—NHOH$ compound II 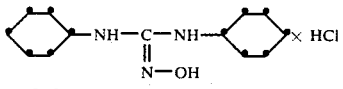

compound III 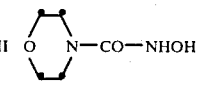

I claim:

1. In a color process reversal for the production of photographic images by image-wise exposure of a light-sensitive photographic material containing at least one silver halide emulsion layer, black and white development, preliminary to second development, treating the developed layer with a stabilizing bath containing fogging metal complexes and then subsequently color developing the material so treated with the improvement wherein said bath having a pH of 3 to 8 containing, in the absence of a color developing agent, a fogging metal complex selected from the group consisting of carboxylic acid and phosphonic acid complexes of tin-II ions with a stabilizing amount of at least one stabilizer or a salt thereof which comprises a compound of the following general formula or a tautomeric form thereof

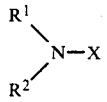

wherein $R^1$ and $R^2$ which are the same or different, represent hydrogen, a saturated or unsaturated aliphatic group, an aryl group, a heterocyclic group or an acyl group;

X represents $OR^3$ or $NR^4R^5$ wherein $R^3$, $R^4$ and $R^5$, which are the same or different, are defined as $R^1$;

and/or $R^1$ and $R^2$ together represent the ring members required for completing a 5-membered or 6-membered ring.

2. The process according to claim 1 characterized in that $R^1$ represents a saturated or unsaturated aliphatic group, an aryl group, a heterocyclic group or an acyl group, X represents OH.

3. The process according to claim 1 characterised in that the stabilizing agent used is hydroxylammonium sulphate.

4. The process according to claim 1, characterised in that at least one tin-II complex of citric acid and/or of 1,2,4-tricarboxybutane-2-phosphonic acid is used as fogging metal complex.

5. In a fogging bath for color reversal processing of silver halide containing photographic materials which bath composition contains in the absence of a color-developing agent a fogging agent capable of fogging imagewise exposed and black and white developed silver halide containing photographic materials, the improvement which comprises the bath having a pH of from 3 to 10 and containing in solution a buffering agent for maintaining said pH and a fogging metal complex, selected from the group consisting of carboxylic acid and phosphonic acid complexes of tin-II ions and a stabilizing amount of at least one stabilizer or a salt thereof which is a compound of the following general formula or to a tautomeric form thereof

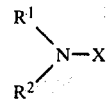

wherein $R^1$ and $R^2$ which are the same or different, represent hydrogen, a saturated or unsaturated aliphatic group, an aryl group, a heterocyclic group or an acyl group;

X represents $OR^3$ or $NR^4R^5$, wherein $R^3$, $R^4$ and $R^5$ which are the same or different, are defined as $R^1$;

and/or $R^1$ and $R^2$ together represent the ring members required for completing a 5-membered or 6-membered ring.

6. The bath according to claim 5 characterised in that $R^1$ represents a saturated or unsaturated aliphatic group, an aryl group, a heterocyclic group or an acyl group, X represents OH.

7. The bath according to claim 5 characterized in that it contains hydroxylammonium sulphate as stabilizing agent.

8. The bath according to claim 5 characterized in that it contains at least one tin-II complex of citric acid and/or of 1,2,4-tricarboxybutane-2-phosphonic acid as fogging metal complex.

* * * * *